US010796836B2

(12) United States Patent
Song et al.

(10) Patent No.: US 10,796,836 B2
(45) Date of Patent: Oct. 6, 2020

(54) INDUCTOR

(71) Applicant: SAMSUNG ELECTRO-MECHANICS CO., LTD., Suwon-si, Gyeonggi-do (KR)

(72) Inventors: Seung Jae Song, Suwon-si (KR); Min Ki Jung, Suwon-si (KR); Han Kim, Suwon-si (KR); Seung Hee Hong, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 203 days.

(21) Appl. No.: 16/128,997

(22) Filed: Sep. 12, 2018

(65) Prior Publication Data

US 2019/0244740 A1 Aug. 8, 2019

(30) Foreign Application Priority Data

Feb. 5, 2018 (KR) ..... 10-2018-0013929

(51) Int. Cl.
*H01F 27/28* (2006.01)
*H01F 17/00* (2006.01)

(52) U.S. Cl.
CPC ..... *H01F 17/0013* (2013.01); *H01F 27/28* (2013.01); *H01F 27/2804* (2013.01); *H01F 2017/002* (2013.01); *H01F 2017/0073* (2013.01)

(58) Field of Classification Search
CPC ..... H01F 27/00–40
USPC ..... 336/65, 83, 90, 192, 200, 232–234
See application file for complete search history.

(56) References Cited

U.S. PATENT DOCUMENTS

| | | | | |
|---|---|---|---|---|
| 7,212,095 | B2 * | 5/2007 | Sato | H01F 17/0033 336/200 |
| 10,229,781 | B2 * | 3/2019 | Sano | H01F 17/0013 |
| 10,580,559 | B2 * | 3/2020 | Lee | H01F 27/323 |
| 2008/0157913 | A1 | 7/2008 | Kim | |
| 2014/0253277 | A1 | 9/2014 | Takezawa | |
| 2015/0294779 | A1 | 10/2015 | Lim | |

FOREIGN PATENT DOCUMENTS

| | | | |
|---|---|---|---|
| JP | 2005-123332 | A | 5/2005 |
| JP | 2014-175383 | A | 9/2014 |
| KR | 10-0869741 | B1 | 11/2008 |
| KR | 10-2015-0117888 | A | 10/2015 |

* cited by examiner

*Primary Examiner* — Tuyen T Nguyen
(74) *Attorney, Agent, or Firm* — Morgan, Lewis & Bockius LLP

(57) ABSTRACT

An inductor includes a body including insulating layers stacked therein, in which coil patterns are respectively disposed on the insulating layers, and first and second external electrodes disposed on an external surface of the body, wherein the coil patterns are connected to each other by a plurality of coil connecting portions, and opposing ends thereof are connected to the first and second external electrodes through coil lead portions, respectively, to form a coil, the coil patterns include outer coil patterns disposed in an outer portion of the body and inner coil patterns disposed in an inner portion, a first coil connecting portion connects the outer coil patterns and a second coil connecting portion connects one coil pattern of the outer coil patterns and another coil pattern of the inner coil patterns, and the first and second coil connecting portions are disposed in a staggered manner.

10 Claims, 10 Drawing Sheets

INDUCTOR

CROSS-REFERENCE TO RELATED APPLICATION

This application claims the benefit of priority to Korean Patent Application No. 10-2018-0013929 filed on Feb. 5, 2018 in the Korean Intellectual Property Office, the disclosure of which is incorporated herein by reference in its entirety.

TECHNICAL FIELD

The present disclosure relates to an inductor.

BACKGROUND

Currently, smartphones use signals of many frequency bands, due to application of multiband long term evolution (LTE). Thus, high frequency inductors are commonly used as impedance matching circuits in signal transmission/reception RF systems. Such high frequency inductors are demanded to have a smaller size and higher capacity. In addition, high frequency inductors have a high self-resonant frequency (SRF) of a high frequency band and low resistivity, and therefore required to be used at a high frequency of 100 MHz or higher. Also, a high Q characteristic is required to reduce loss in a frequency being used.

In order to have such high Q characteristics, characteristics of a material forming a body of an inductor make a greatest influence. However, even when the same material is used, the Q value may vary, according to shapes of an inductor coil. It is necessary to realize an inductor coil structure in which an inner coil structure is uniformly dispersed, while maintaining higher Q characteristics by optimizing the shape of the inductor coil.

SUMMARY

An aspect of the present disclosure may provide an inductor having high Q characteristics and improved reliability of via junction and the dispersion of characteristics.

According to an aspect of the present disclosure, an inductor may include: a body including a plurality of insulating layers stacked therein, wherein a plurality of coil patterns are respectively disposed on the plurality of insulating layers; and first and second external electrodes disposed on an external surface of the body, wherein the plurality of coil patterns are connected to each other by a plurality of coil connecting portions, and opposing ends of the plurality of coil patterns are connected to the first and second external electrodes through coil lead portions, respectively, to form a coil, the plurality of coil patterns include outer coil patterns disposed on an outer portion of the body and inner coil patterns disposed on an inner portion of the body, the outer and inner coil patterns each being connected in parallel, a first coil connecting portion of the plurality of coil connecting portions connects the outer coil patterns, and a second coil connecting portion of the plurality of coil connecting portions connects one coil pattern of the outer coil patterns and another coil pattern of the inner coil patterns adjacent to the one coil pattern of the outer coil patterns, and the first and second coil connecting portions are disposed in a staggered manner.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Exemplary embodiments of the present disclosure will now be described in detail with reference to the accompanying drawings.

Figure 1:
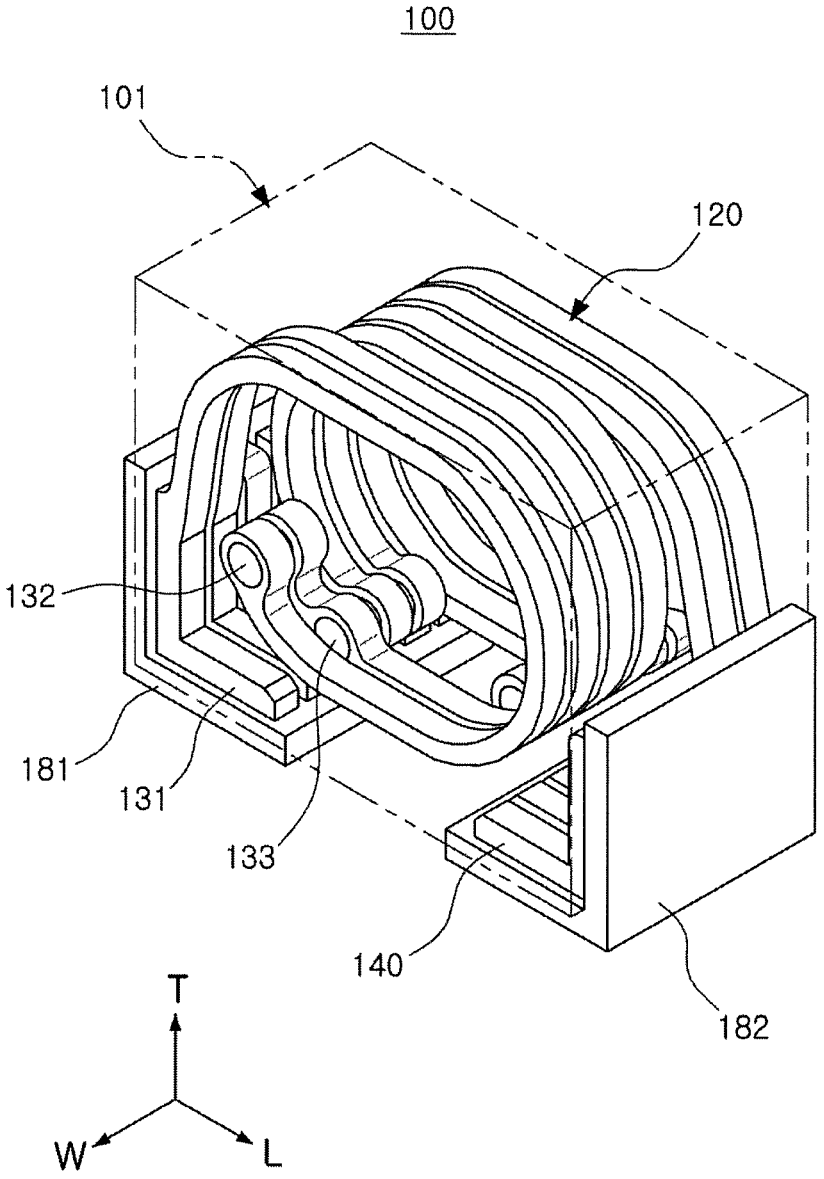
FIG. 1 is a schematic perspective view of an inductor according to a first exemplary embodiment in the present disclosure.

FIG. 1 is a schematic perspective view of an inductor according to a first exemplary embodiment in the present disclosure.

Figure 2:
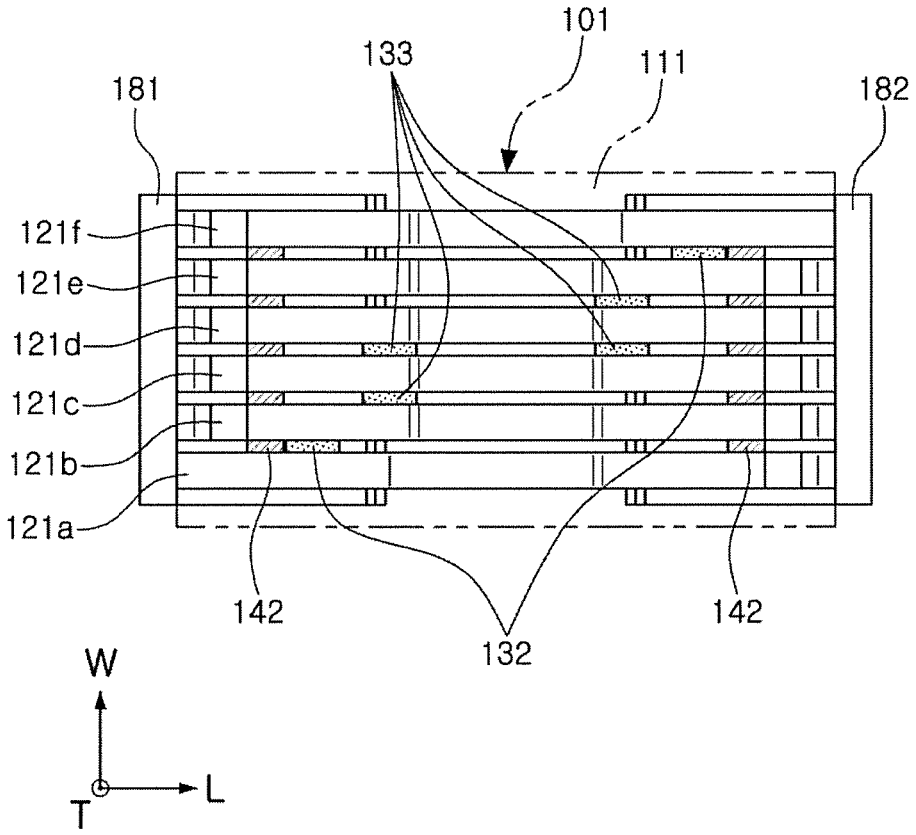
FIG. 2 is a schematic plan view of the inductor of FIG. 1.

FIG. 2 is a schematic plan view of the inductor of FIG. 1.

Figure 3:
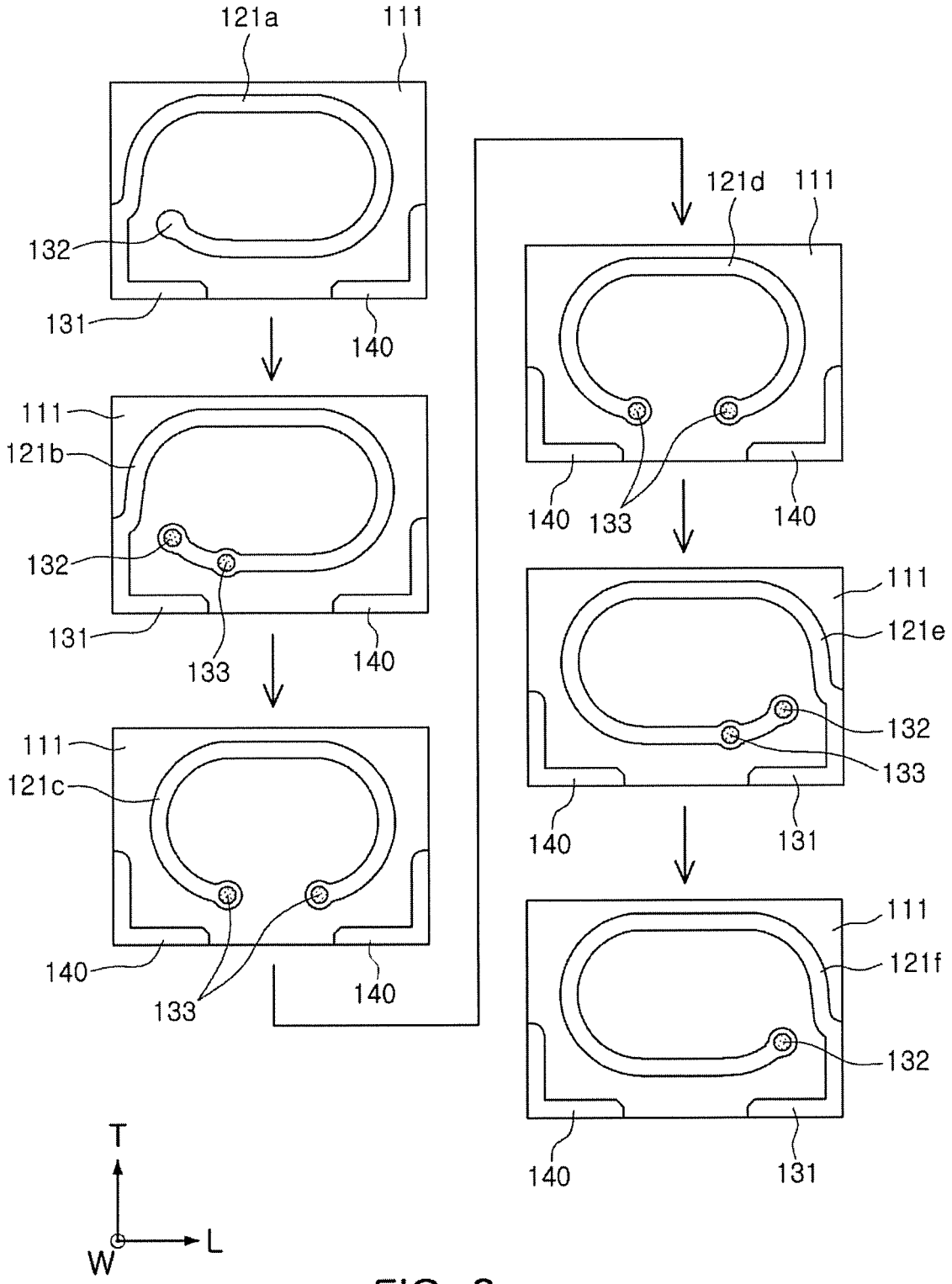
FIG. 3 is a schematic exploded view of the inductor of FIG. 1.

FIG. 3 is a schematic exploded view of the inductor of FIG. 1.

A structure of an inductor 100 according to a first exemplary embodiment in the present disclosure will be described with reference to FIGS. 1 to 3.

The body 101 of the inductor 100 according to an exemplary embodiment in the present disclosure may be formed by stacking a plurality of insulating layers 111 in a first direction horizontal to a mounting surface.

The insulating layer 111 may be a magnetic layer or a dielectric layer.

In a case in which the insulating layer 111 is a dielectric layer, the insulating layer 111 may include $BaTiO_3$ (barium titanate)-based ceramic powder, or the like. In this case, the e $BaTiO_3$-based ceramic powder may be, for example, $(Bai_{1-x}Ca_x)TiO_3$, $Ba(Ti_{1-y}Ca_y)O_3$, $(Ba_{1-x}Ca_x)$ $(Ti_{1-y}Zr_y)O_3$, $Ba(Ti_{1-y}Zr_y)O_3$, and the like, prepared by partially employing Ca, Zr, and the like, in $BaTiO_3$, but the present disclosure is not limited thereto.

In a case in which the insulating layer 111 is a magnetic layer, an appropriate material which may be used as a body of the inductor may be selected as a material of the insulating layer 111, and examples thereof may include resins, ceramics, and ferrite. In this exemplary embodiment, the magnetic layer may use a photosensitive insulating material, whereby a fine pattern may be realized through a photolithography process. That is, by forming the magnetic layer with a photosensitive insulating material, a coil pattern, a coil lead portion 131 and coil connecting portions 132 and 133 may be minutely formed to contribute to miniaturization and function improvement of the inductor 100. To this end, the magnetic layer may include, for example, a photosensitive organic material or a photosensitive resin. In addition, the magnetic layer may further include an inorganic component such as $SiO_2/Al_2O_3/BaSO_4$/Talc as a filler component.

First and second external electrodes 181 and 182 may be disposed on an external surface of the body 101.

For example, the first and second outer electrodes 181 and 182 may be disposed on a mounting surface of the body 101. The mounting surface refers to a surface facing a printed circuit board (PCB) when the inductor 100 is mounted on the PCB.

The external electrodes 181 and 182 serve to electrically connect the inductor 100 to the PCB when the inductor 100 is mounted on the PCB. The external electrodes 181 and 182 are disposed and spaced apart from each other on the edges of the body 101 in a first direction and in a second direction horizontal to the mounting surface. The external electrodes 181 and 182 may include, for example, a conductive resin layer and a conductive layer formed on the conductive resin layer, but are not limited thereto. The conductive resin layer may include at least one conductive metal selected from the group consisting of copper (Cu), nickel (Ni), and silver (Ag) and a thermosetting resin. The conductive layer may include at least one selected from the group consisting of nickel (Ni), copper (Cu), and tin (Sn). For example, a nickel layer and a tin layer may be sequentially formed.

Referring to FIGS. 1 to 3, coil patterns 121*a* to 121*f* may be formed on the insulating layer 111.

The coil patterns 121*a* to 121*f* may be electrically connected to adjacent coil patterns by coil connecting portions 132 and 133. That is, the helical coil patterns 121*a* to 121*f* are connected by the coil connecting portions 132 and 133 to form the coil 120. Both ends of the coil 120 are connected to first and second external electrodes 181 and 182 by the coil lead portion 131, respectively. The coil connecting portions 132 and 133 may have a line width larger than a line width of the coil patterns 121*a* to 121*f* to improve connectivity between the coil patterns 121*a* to 121*f* and include conductive vias penetrating through the insulating layer 111.

The coil lead portion 131 may be exposed to both longitudinal ends of the body 101 and may also be exposed to a lower surface as a board mounting surface. Accordingly, the coil lead portion 131 may have an L-shaped in a cross-section in the length-thickness (L-T) direction of the body 101.

Referring to FIGS. 1 to 3, a dummy electrode 140 may be disposed in the insulating layer 111 at a position corresponding to the external electrodes 181 and 182. The dummy electrode 140 may serve to improve adhesion between the external electrodes 181 and 182 and the body 101 or may serve as a bridge when the external electrodes 181 and 182 are formed by plating.

The dummy electrode 140 and the coil lead portion 131 may be connected to each other by a via electrode 142.

As a material of the coil patterns 121*a* to 121*f*, the coil lead portion 131, and the coil connecting portions 132 and 133, a conductive material such as copper (Cu), aluminum (Al), silver (Ag), tin (Sn), gold (Au), nickel (Ni), lead (Pb), or an alloy thereof, having excellent conductivity may be used. The coil pattern 121 which includes the coil patterns 121*a* to 121*f*, the coil lead portion 131, and the coil connecting portions 132 and 133 may be formed by a plating method or a printing method, but the present disclosure is not limited thereto.

The inductor 100 according to the exemplary embodiment in the present disclosure is formed by forming the coil patterns 121*a* to 121*f*, the coil lead portions 131 or the coil connecting portions 132 and 133, and the like, on the insulating layers 111 and subsequently stacking the insulating layers 111 in the first direction horizontal to the mounting surface, and thus, the inductor 100 may be manufactured more easily than the related art. In addition, since the coil patterns 121*a* to 121*f* are arranged to be perpendicular to the mounting surface, magnetic flux may be prevented from being affected by the mounting substrate.

Referring to FIGS. 2 and 3, in the coil 120 of the inductor 100 according to an exemplary embodiment in the present disclosure, when projected in the first direction, the coil patterns 121 overlap each other to form a coil track having one or more coil turns.

Specifically, the first external electrode 181 and the first and second coil patterns 121*a* and 121*b* are connected by the coil lead portion 131, and thereafter, the first to sixth coil patterns 121*a* to 121*f* are sequentially connected by the coil connecting portions 132 and 133.

The first and second coil patterns 121*a* and 121*b* are connected in parallel and are connected to the first external electrode 181 by the coil lead portion 131. The fifth and sixth coil patterns 121*e* and 121*f* are connected to the second external electrode 182 by the coil lead portion 131.

The third and fourth coil patterns 121*c* and 121*d* disposed inside are connected in parallel and connected to each other by the coil connecting portion 133.

That is, according to the first exemplary embodiment in the present disclosure, the coil patterns 121*a* to 121*f* are connected in parallel to each other by twos.

Referring to FIG. 2, among the coil patterns, the first and second coil patterns 121*a* and 121*b* and the fifth and sixth coil patterns 121*e* and 121*f* of the coil pattern correspond to coil patterns disposed on the outer portion of the body 101, and the third coil pattern 121*c* and the fourth coil pattern 121*d* correspond to coil patterns disposed on the inner portion of the body 101.

At least two or more of the coil patterns disposed on the outer portion of the body 101 and at least two or more of the coil patterns disposed on the inner portion of the body 101 are connected by the same pattern.

That is, connecting coil patterns in parallel means that two or more coil patterns adjacent to each other, among the coil patterns arranged on the insulating layer 111, are the same in shape and are connected to each other by the coil connecting portions 132 and 133.

The coil patterns 121*c* and 121*d* arranged on the inner portion of the body 101 and adjacent to the coil patterns 121*a*, 121*b*, 121*e*, and 121*f* arranged on the outer portion of the body 101 have different shapes.

That is, the third coil pattern 121*c* adjacent to the first and second coil patterns 121*a* and 121*b*, which are coil patterns disposed on the outer portion of the body 101, has a shape different from the shapes of the first and second coil patterns 121*a* and 121*b*.

Similarly, the fourth coil pattern 121*d* adjacent to the fifth and sixth coil patterns 121*e* and 121*f*, which are coil patterns disposed on the outer portion of the body 101, has a shape of different from the shapes of the fifth and sixth coil patterns 121*e* and 121*f*.

Referring to FIG. 2, in the inductor 100 according to the first exemplary embodiment in the present disclosure, the plurality of coil patterns 121*a* to 121*f* include coil patterns 121*a*, 121*b*, 121*e*, 121*f* disposed on the outer portion of the body 101 and coil patterns 121*c* and 121*d* disposed on the inner portion of the body 101. The coil patterns 121*a* to 121*f* are connected in parallel, and a first coil connecting portion 132 connecting the coil patterns 121*a*, 121*b*, 121*e*, and 121*f* connected in parallel on the outer portion of the body 101 and a second coil connecting portion 133 connecting the coil patterns 121*a*, 121*b*, 121*e*, and 121*f* connected in parallel on the outer portion of the body 101 and the adjacent coil patterns 121*c* and 121*d* on the inner portion of the body 101 are disposed in a staggered manner.

According to the first exemplary embodiment in the present disclosure, the coil connecting portions include the first coil connecting portion 132 connecting the coil patterns 121*a*, 121*b*, 121*e*, and 121*f* connected in parallel to the outer portion of the body 101 and the second coil connecting portion 133 connecting the coil patterns disposed on the outer portion of the body 101 and the adjacent coil patterns disposed on the inner portion of the body 101.

Also, the second coil connecting portion 133 may connect the coil patterns 121*c* and 121*d* connected in parallel and disposed on the inner portion of the body 101.

As illustrated in FIG. 3, the coil patterns 121*a*, 121*b*, 121*e*, and 121*f* disposed on the outer portion of the body 101 refer to coil patterns disposed to be adjacent to opposing side surfaces of the body in the stacking direction of the plurality of coil patterns 121, i.e., in the width direction of the body 101.

The first and sixth coil patterns 121*a* and 121*f*, among the coil patterns 121*a*, 121*b*, 121*e*, and 121*f* disposed on the outer portion of the body 101, refer to coil patterns which do not have an adjacent coil pattern in the direction of the opposing side surfaces and which have coil patterns adjacent thereto only in an inward direction.

The coil patterns 121*c* and 121*d* disposed on the inner portion of the body 101 refer to a plurality of coil patterns disposed on the internal surfaces of the outer coil patterns 121*a*, 121*b*, 121*e*, and 121*f* disposed to be adjacent to the opposing side surfaces of the body 101 in the width direction (W) of the body 101.

In the related art, it is designed that the coil connecting portions connecting the coil patterns are positioned on the same line. In this case, the related art inductor is subjected to a process in which pressure is applied during a manufacturing process, and here, the thicknesses of an outer region of the coil connecting portions where the coil patterns are disposed and a region of the coil connecting portion are not uniform due to the overlapping coil connecting portions.

Such non-uniformity of the thickness causes imbalance in the length of a magnetic path, which causes scattering of inductor characteristics.

In the inductor according to the first exemplary embodiment in the present disclosure, the first coil connecting portion 132 connecting the coil patterns 121*a*, 121*b*, 121*e*, and 121*f* connected in parallel to each other on the outer portion of the body 101 and the second coil connecting portion 133 connecting the internal coil patterns 121*c* and 121*d* adjacent to the coil patterns 121*a*, 121*b*, 121*e*, and 121*f* connected in parallel to each other on the outer portion of the body 101 are disposed in a staggered manner.

In this manner, since the first coil connecting portion 132 connecting the coil patterns 121*a*, 121*b*, 121*e*, and 121*f* connected in parallel to each other on the outer portion of the body 101 and the second coil connecting portion 133 connecting the internal coil patterns 121*c* and 121*d* adjacent to the coil patterns 121*a*, 121*b*, 121*e*, and 121*f* connected in parallel to each other on the outer portion of the body 101 are disposed in a staggered manner, the problem that the thicknesses of an outer region of the coil connecting portions where the coil patterns are disposed and a region of the coil connecting portion are not uniform due to the overlapping coil connecting portions may be solved.

In other words, according to the first exemplary embodiment in the present disclosure, since the coil connecting portions do not overlap as in the related art, there is no non-uniformity in thickness between the outer region of the coil connecting portions where the coil patterns are disposed and the region of the coil connecting portion, and as a result, the length of the magnetic path may be balanced, improving the problem of scattering of characteristics of the inductor.

According to the first exemplary embodiment in the present disclosure, since the first coil connecting portion 132 and the second coil connecting portion 133 are disposed in a staggered manner, defective bonding between the coil connecting portions and pads of the coil connecting portions is reduced.

In the first exemplary embodiment in the present disclosure, the method of disposing the first coil connecting portion 132 connecting the coil patterns 121*a*, 121*b*, 121*e*, and 121*f* connected in parallel on the outer portion of the body 101 and the second coil connecting portion 133 connecting the internal coil patterns 121*c* and 121*d* adjacent to the coil patterns 121*a*, 121*b*, 121*e*, and 121*f* connected in parallel on the outer portion of the body 101 in a staggered manner may be variously performed and is not particularly limited.

For example, the second coil connecting portion 133 connecting the second coil pattern 121*b* and the third coil pattern 121*c* may be formed not to overlap the first coil connecting portion 132 connecting the first coil pattern 121*a* and the second coil pattern 121*b*.

The method of forming the first coil connecting portion 132 and the second coil connecting portion 133 may be performed in the same manner as a method of forming a general via.

That is, according to the first exemplary embodiment in the present disclosure, the method of forming the first coil connecting portion 132 and the second coil connecting portion 133 is the same as the related art method, except that the first coil connecting portion 132 and the second coil connecting portion 133 are formed at positions which do not overlap each other so as to stagger.

According to the first exemplary embodiment in the present disclosure, the coil connecting portions 132 and 133 connecting the plurality of coil patterns 121*a* to 121*f* are each provided between respective coil patterns.

Referring to FIGS. 1 to 3, one first coil connecting portion 132 connects the first coil pattern f121*a* and the second coil pattern 121*b*, and one second coil connecting portion connects the second coil pattern 121*b* and the third coil pattern 121*c*. In addition, each of other coil connecting portions connects the respective coil patterns.

According to the first exemplary embodiment in the present disclosure, since the first coil connecting portion 132 and the second coil connecting portion 133 are disposed in a staggered manner, the problem of scattering the characteristics of the inductor 100 may be improved and defective bonding between the coil connecting portions and the pads of the coil connecting portions may be reduced.

Therefore, although two or more coil connecting portions for connecting the coil patterns are not formed as in the related art, there is no problem of defective bonding or defective connection of the coil connecting portions, which simplifies the process.

According to the first exemplary embodiment in the present disclosure, the first coil connecting portion 132 and the second coil connecting portion 133 may be disposed on one side with respect to the center of the body 101 in a length (L) direction of the coil pattern 121.

According to a second exemplary embodiment in the present disclosure, which will be described thereafter, the first coil connecting portion 132 and the second coil connecting portion 133 are disposed in a staggered manner and a distance therebetween is relatively short compared to a distance between the first and second coil connecting portions 132 and 133 in the first exemplary embodiment. Here, the first coil connecting portion 132 and the second coil connecting portion 133 may be disposed on one side with respect to the center of the body 101 in the length (L) direction.

As described hereinafter, according to a third exemplary embodiment in the present disclosure, the first coil connecting portion 132 and the second coil connecting portion 133 may be disposed on different sides with respect to the center of the body 101 in the length (L) direction. This will be described hereinafter.

Figure 4:
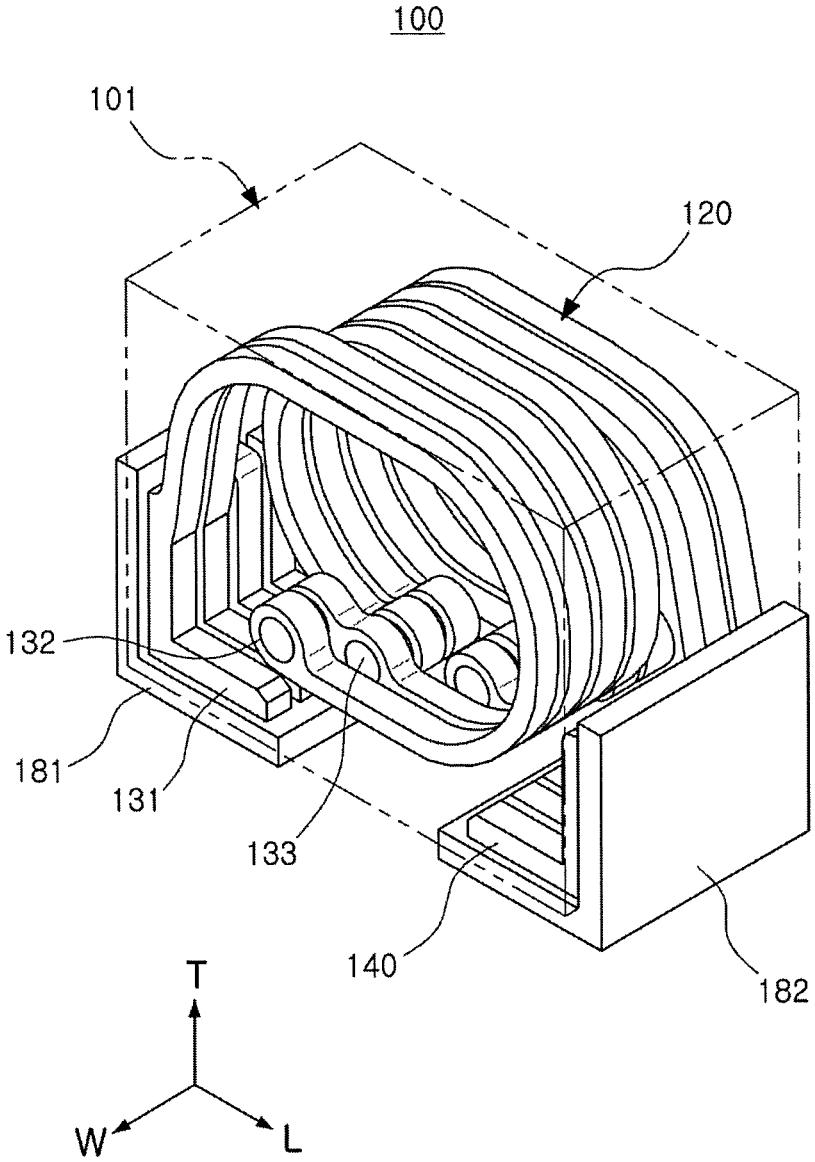
FIG. 4 is a schematic perspective view of an inductor according to a second exemplary embodiment in the present disclosure.

FIG. 4 is a schematic perspective view of an inductor according to a second exemplary embodiment in the present disclosure.

Figure 5:
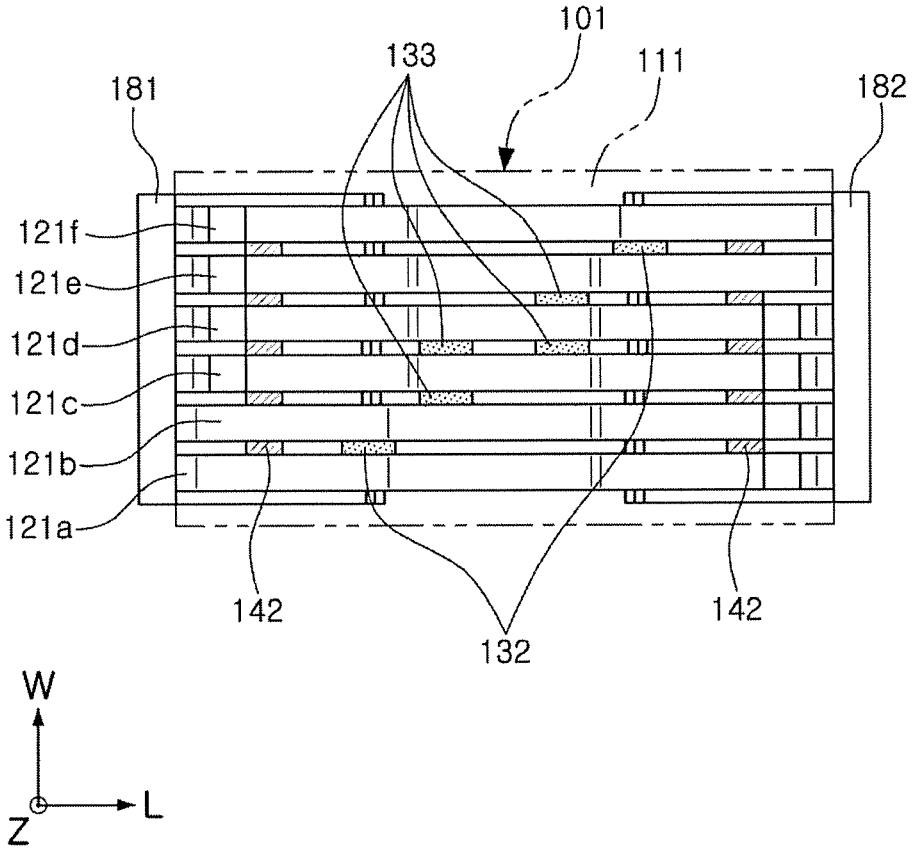
FIG. 5 is a schematic plan view of the inductor of FIG. 4.

FIG. 5 is a schematic plan view of the inductor of FIG. 4.

Figure 6:
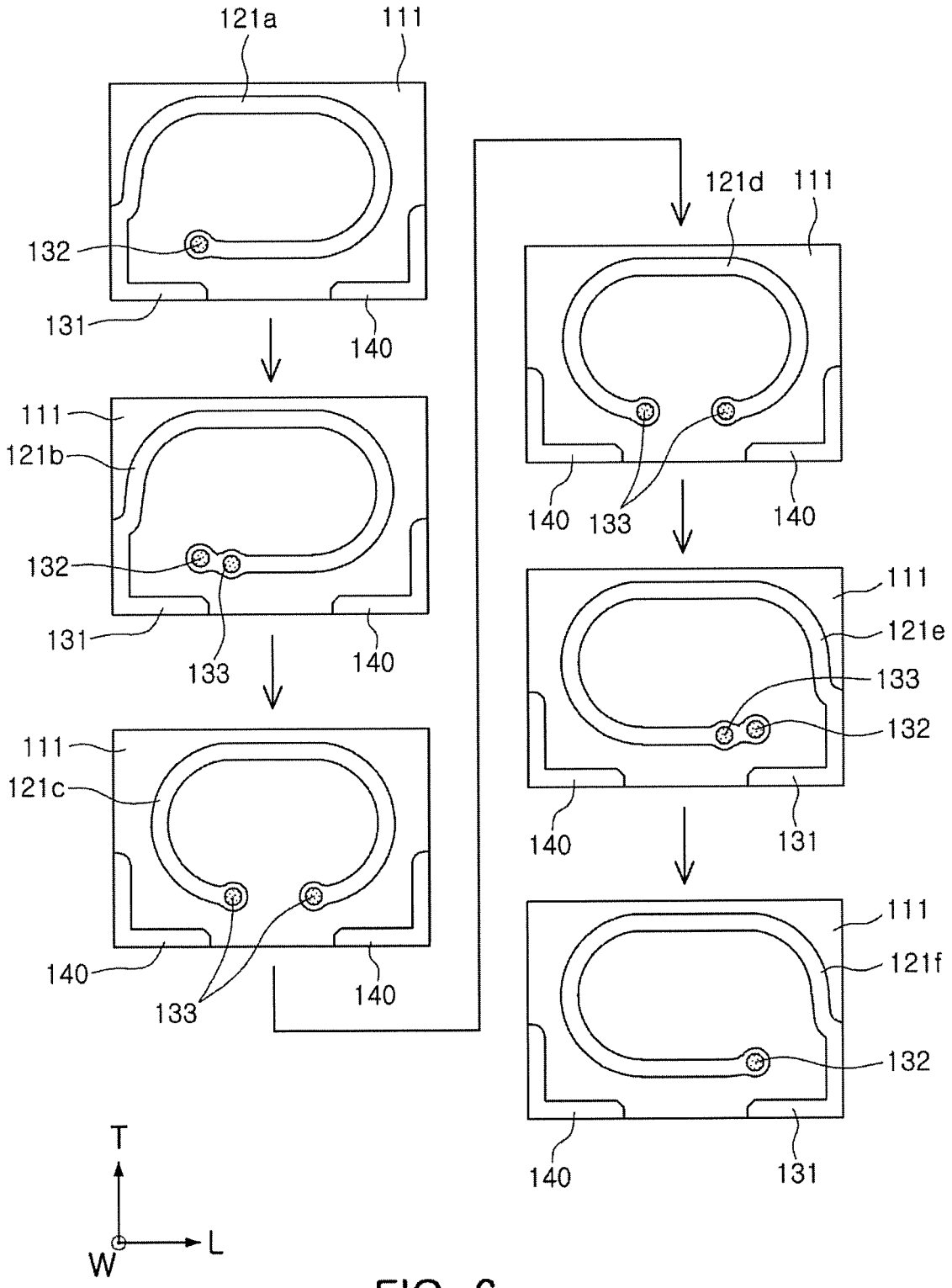
FIG. 6 is a schematic exploded view of the inductor of FIG. 4.

FIG. 6 is a schematic exploded view of the inductor of FIG. 4.

Referring to FIGS. 4 to 6, in the inductor according to the second exemplary embodiment in the present disclosure, the first coil connecting portion 132 and the second coil connecting portion 133 may be in contact with each other.

In this case, the first coil connecting portion 132 and the second coil connecting portion 133 are also disposed in a staggered manner as described in the first exemplary embodiment in the present disclosure, but a distance therebetween is shorter than that of the first exemplary embodiment of the present disclosure. In this case, the number of turns of the coil patterns 121*c* and 121*d* disposed on the inner portion of the body 101 may be increased, compared with the first exemplary embodiment.

Thus, inductance of the inductor may be further increased and adjustment may be easily performed to obtain desired inductance through this method.

Figure 7:
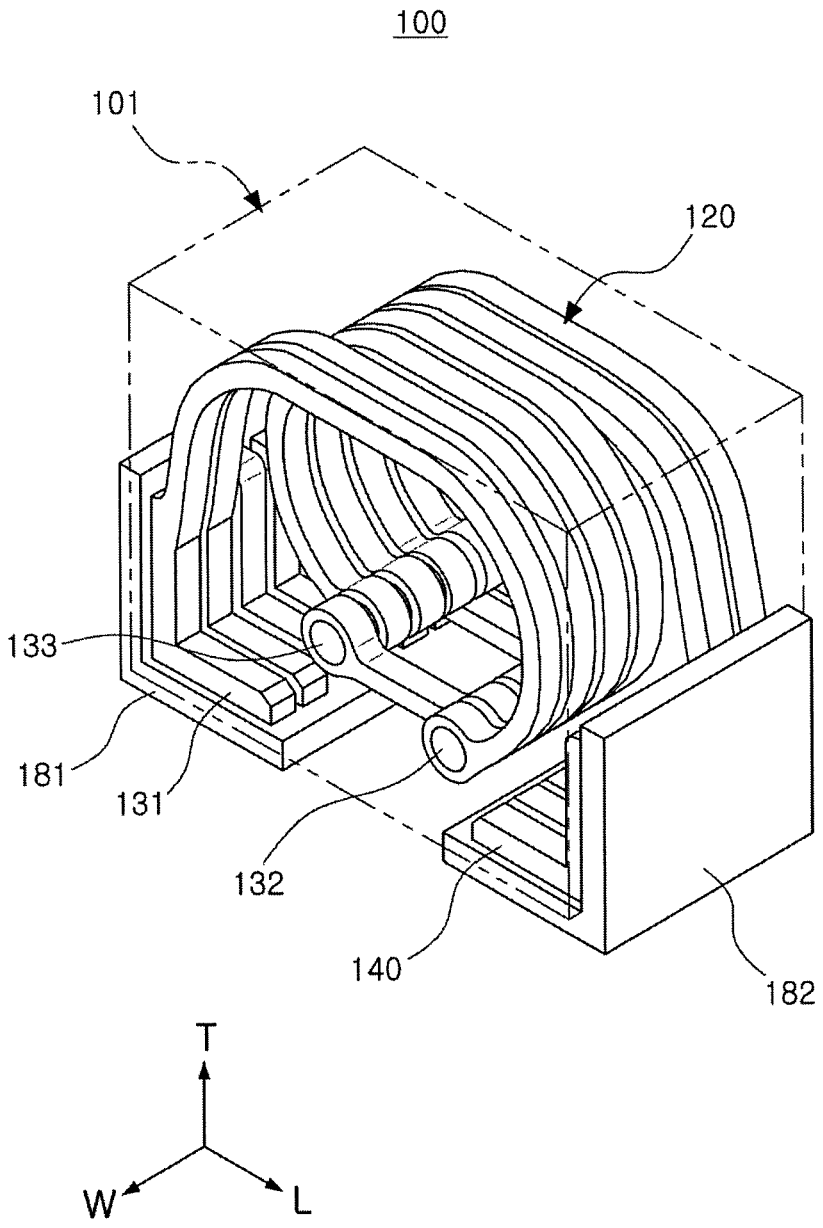
FIG. 7 is a schematic perspective view of an inductor according to a third exemplary embodiment in the present disclosure.

FIG. 7 is a schematic perspective view of an inductor according to a third exemplary embodiment in the present disclosure.

Figure 8:
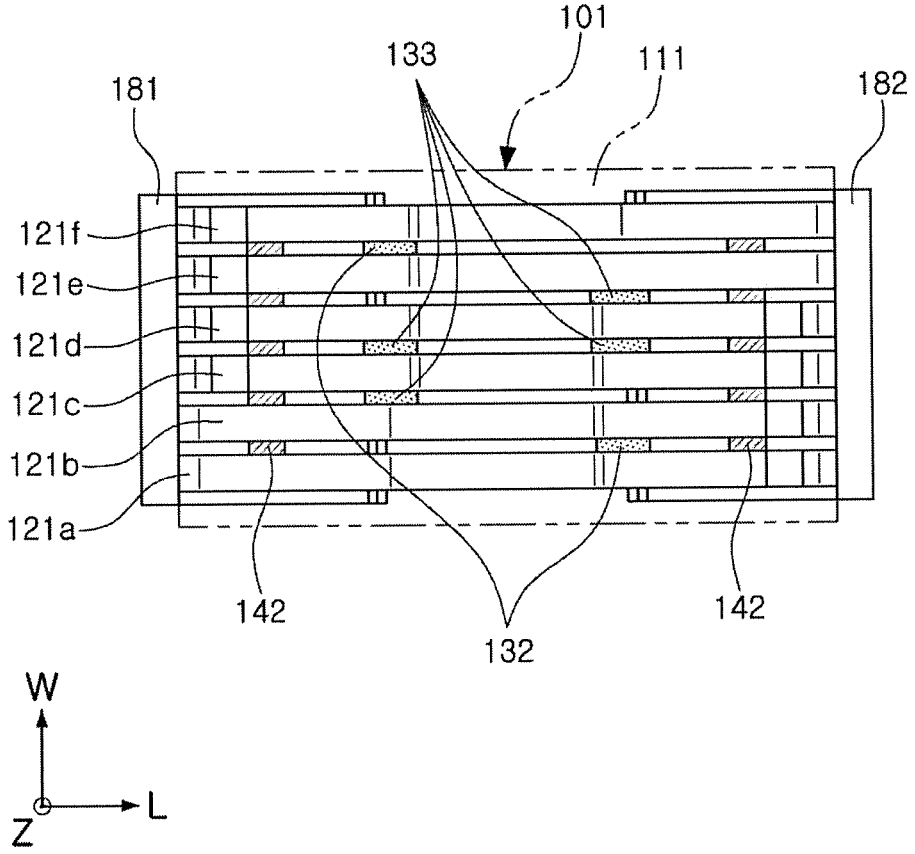
FIG. 8 is a schematic plan view of the inductor of FIG. 7.

FIG. 8 is a schematic plan view of the inductor of FIG. 7.

Figure 9:
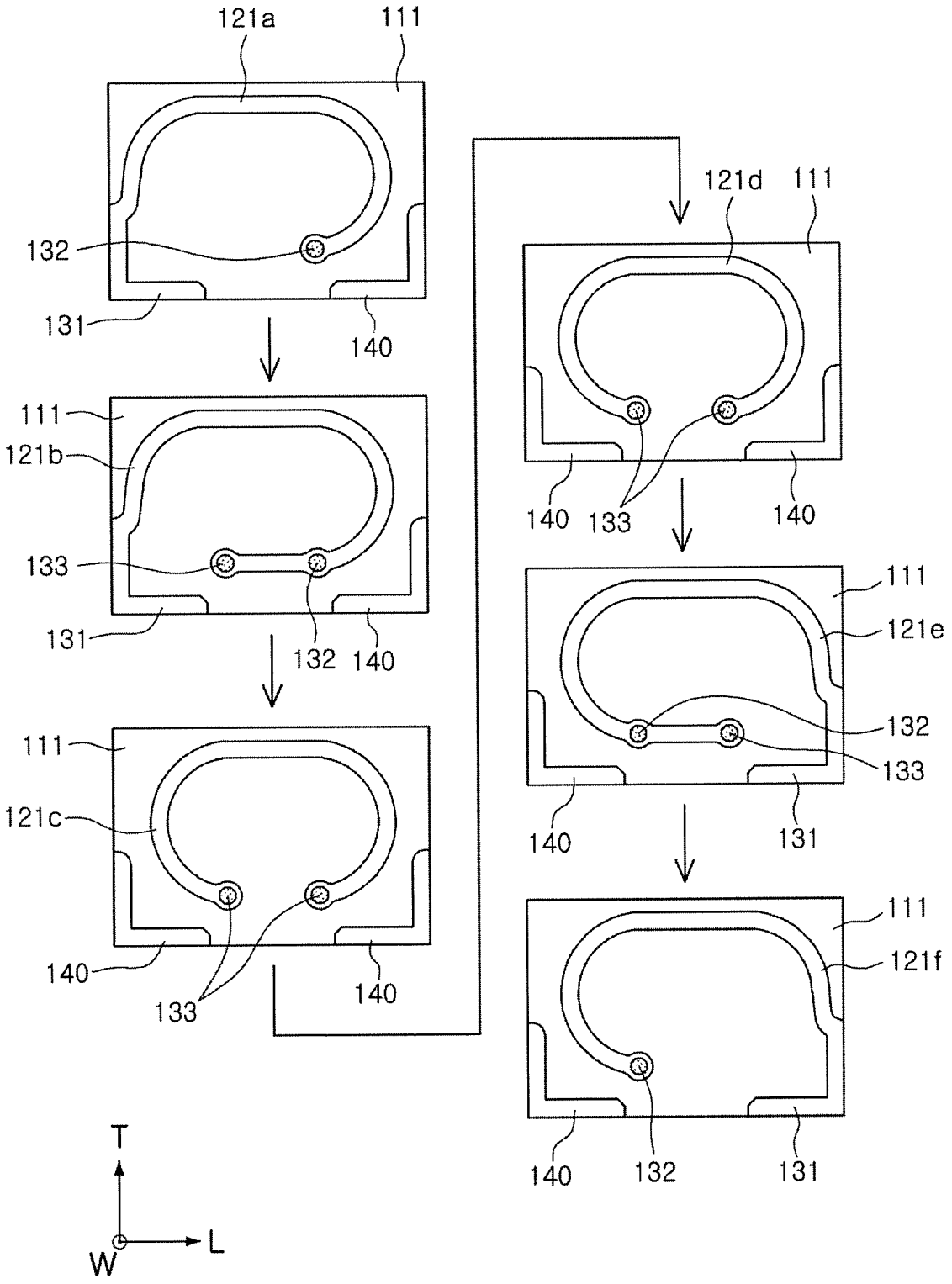
FIG. 9 is a schematic exploded view of the inductor of FIG. 7.

FIG. 9 is a schematic exploded view of the inductor of FIG. 7.

Referring to FIGS. 7 to 9, according to the third exemplary embodiment in the present disclosure, the first coil connecting portion 132 and the second coil connecting portion 133 may be disposed on different longitudinal sides with respect to the longitudinal center of the body 101.

According to the third exemplary embodiment in the present disclosure, the first coil connecting portion 132 and the second coil connecting portion 133 are disposed in a staggered manner and a distance therebetween is relatively long. Here, the first coil connecting portion 132 and the second coil connecting portion 133 may be disposed on different longitudinal sides with respect to the longitudinal center of the body 101.

According to the third exemplary embodiment in the present disclosure, the first coil connecting portion 132 and the second coil connecting portion 133 are disposed on different longitudinal sides with respect to the longitudinal center of the body 101, the effect of improving scattering of the characteristics of the inductor may be more excellent.

That is, the thickness between the outer region of the coil connecting portions where the coil patterns are disposed and the region of the coil connecting portion may be maintained to be uniform, and as a result, the length of the magnetic path may be balanced, further improving scattering of characteristics of the inductor.

Figure 10:
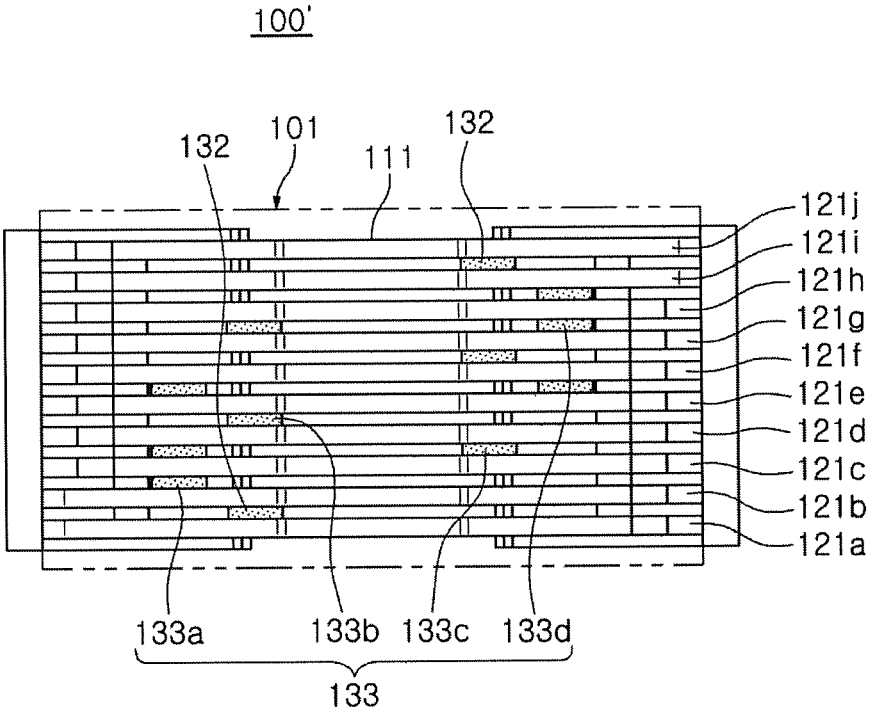
FIG. 10 is a schematic plan view of an inductor according to a fourth exemplary embodiment in the present disclosure.

FIG. 10 is a schematic plan view of an inductor 100' according to a fourth exemplary embodiment in the present disclosure.

Referring to FIG. 10, in the inductor 100' according to the fourth exemplary embodiment in the present disclosure, a coil connecting portion connecting coil patterns connected in parallel, among the coil patterns 121*c* to 121*h* connected in parallel and disposed on the inner portion of the body 101, and a coil connecting portion connecting adjacent coil patterns may be disposed in a staggered manner.

That is, among the plurality of coil patterns 121*a* to 121*j*, first and second coil patterns 121*a* and 121*b* and ninth and tenth coil patterns 121*i* and 121*j* correspond to coil patterns disposed on the outer portion of the body 101 and third to eighth coil patterns 121*c* to 121*h* correspond to coil patterns disposed on the inner portion of the body 101.

The second coil connecting portion 133 connecting the coil patterns 121*c* to 121*h* connected in parallel and disposed on the inner portion of the body 101 may include four coil connecting portions 133*a*, 133*b*, 133*c*, and 133*d*, and the coil connecting portions 133*a*, 133*b*, 133*c*, and 133*d* may be disposed in a staggered manner.

In this manner, in a case in which the number of coil patterns increases, the coil connecting portions connecting the coil patterns disposed on an inner portion of a body are disposed in a staggered manner, whereby the coil connecting portions do not overlap as in the related art, eliminating non-uniformity in thickness between the outer region of the coil connecting portions where the coil patterns are disposed and the region of the coil connecting portion, and, as a result, the length of the magnetic path may be balanced, improving the problem of scattering of characteristics of the inductor.

Further, according to the first exemplary embodiment in the present disclosure, since the first coil connecting portion 132 and the second coil connecting portion 133 are disposed in a staggered manner, defective bonding between the coil connecting portions and the pads of the coil connecting portions may be reduced.

A detailed description of the same features of the inductors according to the second to fourth exemplary embodiments of the present disclosure as those of the inductor according to the first exemplary embodiment in the present disclosure will be omitted.

As set forth above, in the inductors according to exemplary embodiments of the present disclosure, since the coil connecting portions connecting the coil patterns connected in parallel to each other and the coil connecting portions connecting the adjacent internal coil patterns on an inner portion of a body are disposed in a staggered manner, non-uniformity in the thicknesses of the region of the via and the outer region of the via may be improved, while maintaining the Q characteristics of the inductors at the same level as that of the related art, to reduce scattering of the characteristics and improve reliability of via bonding.

While exemplary embodiments have been shown and described above, it will be apparent to those skilled in the art that modifications and variations could be made without departing from the scope of the present disclosure as defined by the appended claims.

What is claimed is:

1. An inductor comprising:

a body including a plurality of insulating layers stacked therein, wherein a plurality of coil patterns are respectively disposed on the plurality of insulating layers; and first and second external electrodes disposed on an external surface of the body, wherein:

the plurality of coil patterns are connected to each other by a plurality of coil connecting portions, and opposing ends of the plurality of coil patterns are connected to the first and second external electrodes through coil lead portions, respectively, to form a coil, the plurality of coil patterns include outer coil patterns disposed in an outer portion of the body and inner coil patterns disposed in an inner portion of the body, the outer and inner coil patterns each being connected in parallel, a first coil connecting portion of the plurality of coil connecting portions connects the outer coil patterns, and a second coil connecting portion of the plurality of coil connecting portions connects one coil pattern of the outer coil patterns and another coil pattern of the inner coil patterns adjacent to the one coil pattern of the outer coil patterns, and the first and second coil connecting portions are disposed in a staggered manner.

2. The inductor of claim 1, wherein the plurality of coil patterns connected in parallel include at least two or more same patterns.

3. The inductor of claim 1, wherein the inner coil patterns disposed adjacent to the outer coil patterns have a pattern shape different from that of the outer coil patterns.

4. The inductor of claim 1, wherein the plurality of coil patterns are stacked in a stacking direction perpendicular with respect to a board mounting surface.

5. The inductor of claim 1, wherein the first coil connecting portion and the second coil connecting portion are in contact with each other.

6. The inductor of claim 1, wherein the first coil connecting portion and the second coil connecting portion are disposed on one side with respect to the center of the body in a length direction of the plurality of coil patterns.

7. The inductor of claim 1, wherein the first coil connecting portion and the second coil connecting portion are disposed on different sides with respect to the center of the body in a length direction of the plurality of coil patterns.

8. The inductor of claim 1, wherein the plurality of coil connecting portions connecting the plurality of coil patterns are each provided between adjacent coil patterns among the plurality of coil patterns.

9. The inductor of claim 1, wherein the coil connecting portion connecting coil patterns connected in parallel, among the inner coil patterns connected in parallel, and the coil connecting portion connecting adjacent coil patterns are disposed in a staggered manner.

10. The inductor of claim 1, further comprising one or more dummy electrodes disposed in the plurality of insulating layers at a position corresponding to the first and second external electrodes, wherein the one or more dummy electrodes and the coil lead portions are connected to each other by a via electrode.

* * * * *